US007562514B2

(12) United States Patent
Bates

(10) Patent No.: US 7,562,514 B2
(45) Date of Patent: Jul. 21, 2009

(54) SADDLES

(75) Inventor: Kenneth John Bates, Darlington (AU)

(73) Assignee: Hammersmith Nominees Pty Ltd., West Perth, Western Australia (AU)

( * ) Notice: Subject to any disclaimer, the term of this patent is extended or adjusted under 35 U.S.C. 154(b) by 0 days.

(21) Appl. No.: 11/588,874

(22) Filed: Oct. 27, 2006

(65) Prior Publication Data

US 2007/0137149 A1 Jun. 21, 2007

(30) Foreign Application Priority Data

Nov. 4, 2005 (AU) ..... 2005906128

(51) Int. Cl.
*B68C 1/02* (2006.01)

(52) U.S. Cl. ..... 54/44.5; 54/44.1

(58) Field of Classification Search ..... 54/44.1, 54/44.5

See application file for complete search history.

(56) References Cited

U.S. PATENT DOCUMENTS 1,397,128 A * 11/1921 Keithley ..... 54/44.5
4,414,791 A * 11/1983 Freeze ..... 54/44.3
4,524,570 A * 6/1985 Racinet ..... 54/44.5
5,740,665 A * 4/1998 Belton ..... 54/44.1
6,434,915 B1 * 8/2002 DeCosemo ..... 54/44.1
2002/0189211 A1 * 12/2002 DeCosemo ..... 54/44.1

FOREIGN PATENT DOCUMENTS

GB 2171883 A * 9/1986
WO WO84/00950 * 3/1984

* cited by examiner

*Primary Examiner*—Son T. Nguyen
(74) *Attorney, Agent, or Firm*—Knobbe Martens Olson & Bear LLP

(57) ABSTRACT

A saddle for equestrian use has on each of its flaps a knee roll which is of generally concave shape at its rear face to retain the thigh of the rider. This is of particular advantage in saddles for use in dressage and endurance events and tends to prevent the rider's leg from moving over the knee roll during working movements of the horse.

5 Claims, 6 Drawing Sheets

SADDLES

BACKGROUND OF THE INVENTION

1. Field of the Invention

The present invention relates to a saddle for equestrian use.

2. Description of the Prior Art

Conventionally, most equestrian saddles include in the forward part of the flap which lies at each side of the saddle, a so-called knee roll which is a pad which lies forwardly of the position occupied by the thigh of the rider. FIG. 1 shows a saddle flap 2 with a conventional knee roll 4 from which it will be seen that its rear part, which is the part closest to the rider's thigh, is generally of a gently curving convex shape and as a result the leg tends to ride up and over the pad during working movements of the horse.

SUMMARY OF THE INVENTION

We have now determined that in some circumstances, particularly but not exclusively for saddles use in dressage and endurance events, it is desirable for the leg of the rider to be held down more securely and this can be achieved by appropriately configuring the rearward part of the pad.

According to the present invention, there is provided a saddle for equestrian use, the saddle having flaps wherein the forward part of each flap includes a knee roll, the rear face of the knee roll over at least part of its length being configured to retain the thigh of the rider when the thigh is applied thereto.

Further according to the present invention, there is provided a saddle for equestrian use, the saddle having flaps wherein the forward part of each flap is padded to form a knee roll, the rear face of the knee roll being shaped over at least part of its length to approximately match the adjacent part of the rider's thigh whereby the thigh will tend to fit into the rear face when applied thereto.

Still further according to the invention, there is provided a saddle for equestrian use, the saddle having flaps wherein the forward part of each flap is padded to form a knee roll, the knee roll being so constructed that its rear face when engaged by a rider's thigh will have over at least part of its length a generally concave shape approximately matching the adjacent part of the rider's thigh whereby the thigh will tend to be retained against the flap by the knee roll.

With the shaping of the rear face of the knee roll as defined above, the rider's leg will be held more securely against the flap and will tend not to ride over the knee roll as occurs with knee rolls of a more conventional shape.

The knee roll is preferably defined by an insert consisting of a relatively firm and hard moulding, preferably of a suitable foam, having on its rear face a soft, compressible, lining, also preferably of a suitable foam, to provide comfort for the rider.

BRIEF DESCRIPTION OF THE DRAWINGS

An embodiment of the invention will now be described by way of example only with reference to the accompanying drawings in which.

DESCRIPTION OF THE PREFERRED EMBODIMENTS

Figure 1:
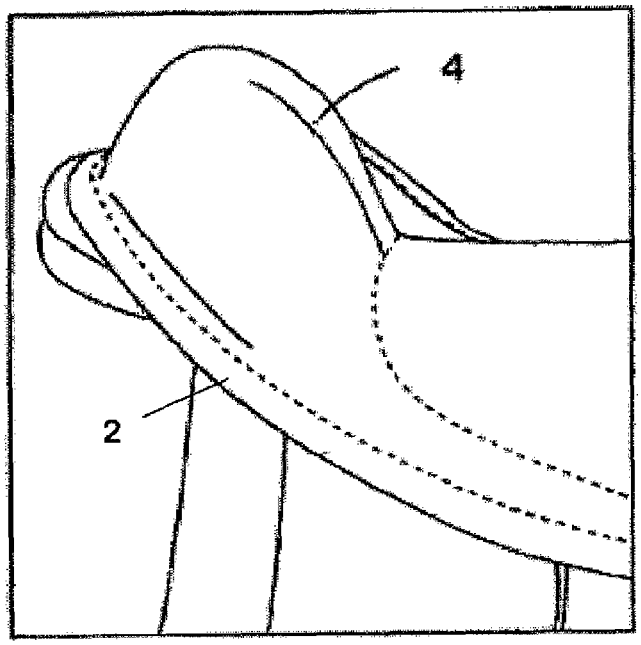
FIG. 1 (Prior Art)
FIG. 1 is prior art showing a saddle flap with a conventional knee roll.
Figure 2:
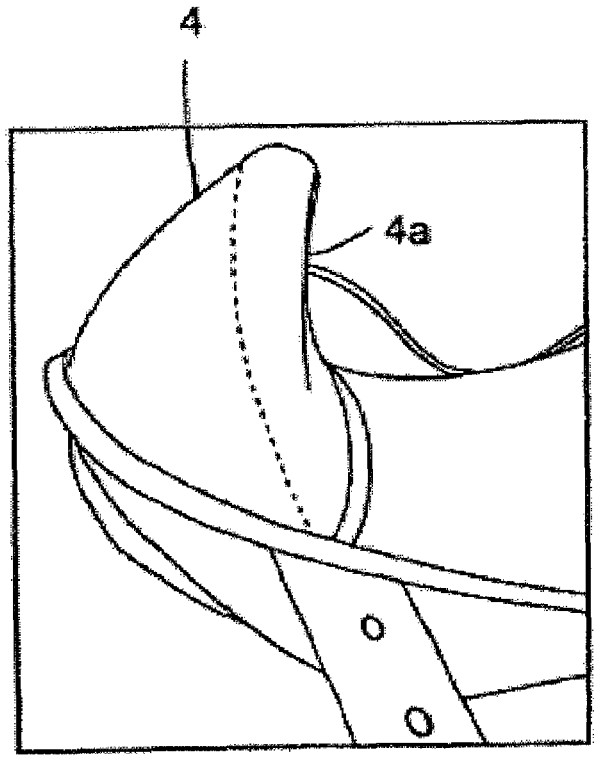
FIG. 2 is a view similar to FIG. 1 but showing a saddle flap with a knee roll shaped in accordance with the principles of the present invention.
Figure 3:
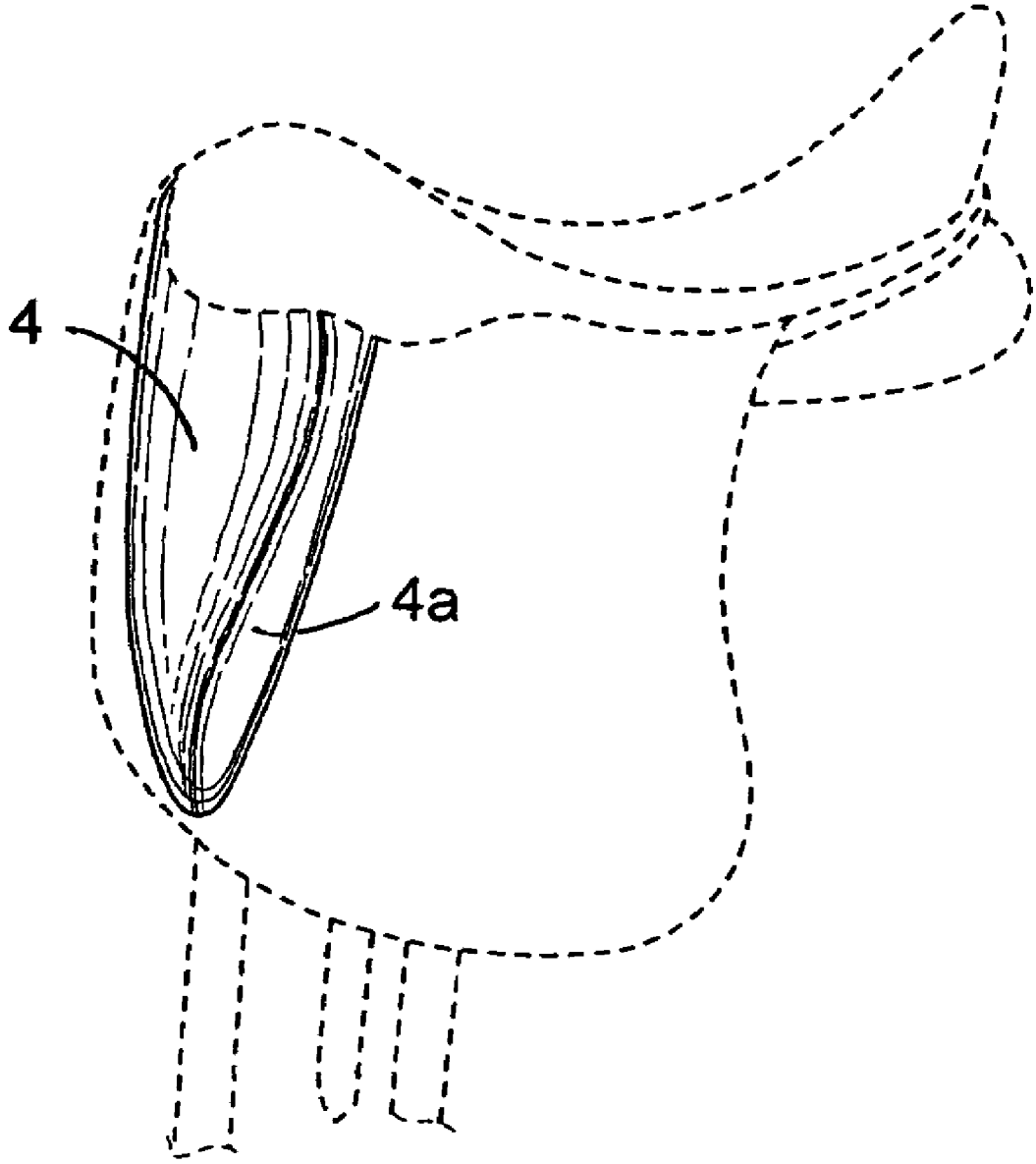
FIG. 3 is a side view of a saddle having a saddle flap with a knee roll shaped in accordance with the principles of the present invention.
Figure 4:
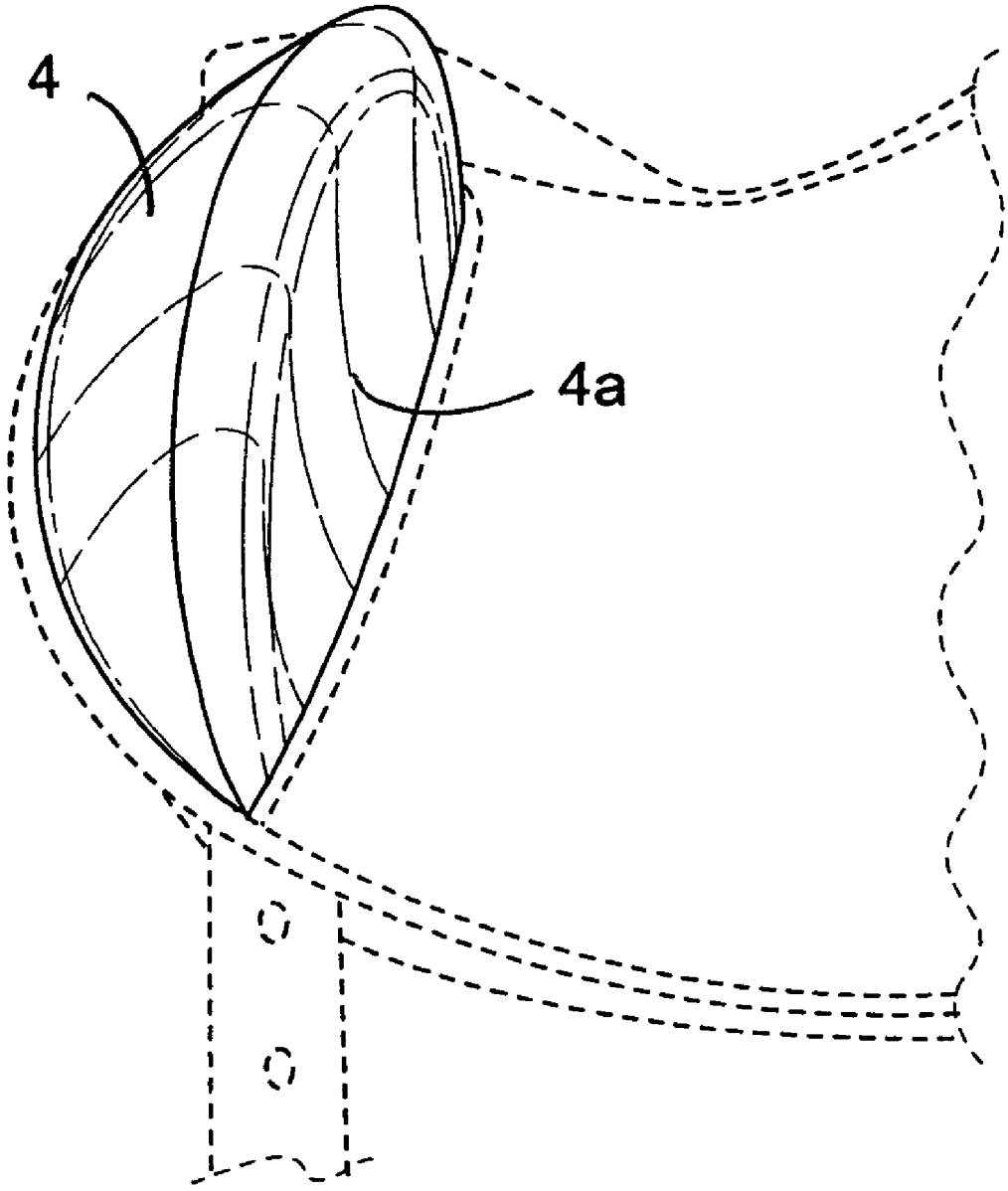
FIG. 4 is a view looking along the length of the knee roll from the lower edge of the flap to better illustrate its shape.
Figure 5:
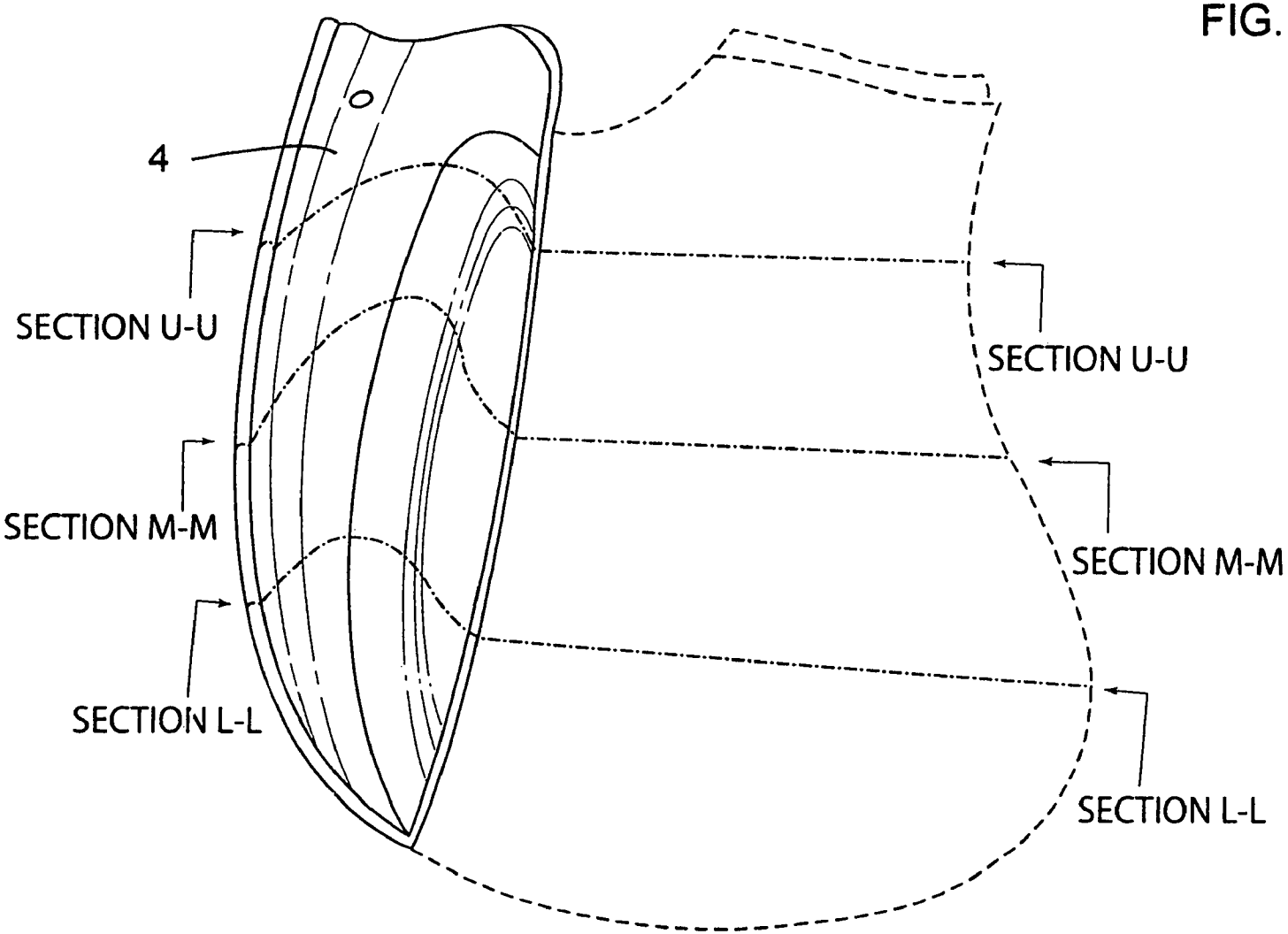
FIG. 5 is a side view of the knee roll.

With reference to FIGS. 2 to 8, a saddle in accordance with the preferred embodiment of the invention has at each side a flap 2 with a pad 4 at its forward part to define a knee roll lying forwardly of the rider's thigh. However in contrast to the conventional knee roll pads discussed above, the rear part 4*a* of the pad 4 projects more acutely from the adjacent surface of the saddle flap 4 and is, over at least part of its length of a generally concave shape which generally matches the shape of the rider's thigh so that the thigh will fit into the pad and be held down by the pad thereby preventing the leg from riding up and over the pad.

The pad is shaped by a foam insert 6 (see FIGS. 6 to 8) incorporated into the saddle flap and covered with a thin layer 7 of a suitable material such as leather or a synthetic material. Advantageously the insert 6 is of two-part construction consisting of a moulding 8 of a relatively firm and hard foam and a lining layer 10 of a relatively soft foam attached to its rearward face to provide the rear surface of the insert against which the rider's thigh will rest thereby providing for significant rider comfort.

Figure 6:
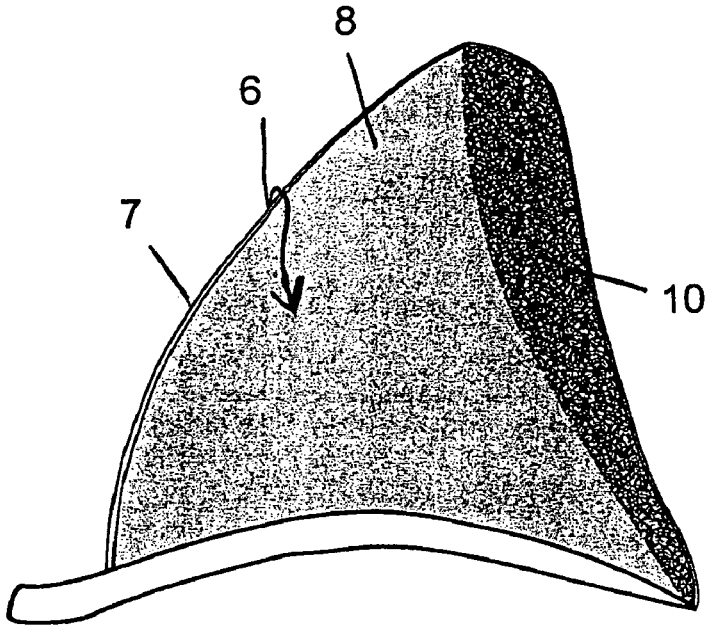
FIG. 6 is a cross-section through the knee roll on line M-M of FIG. 5.
Figure 7:
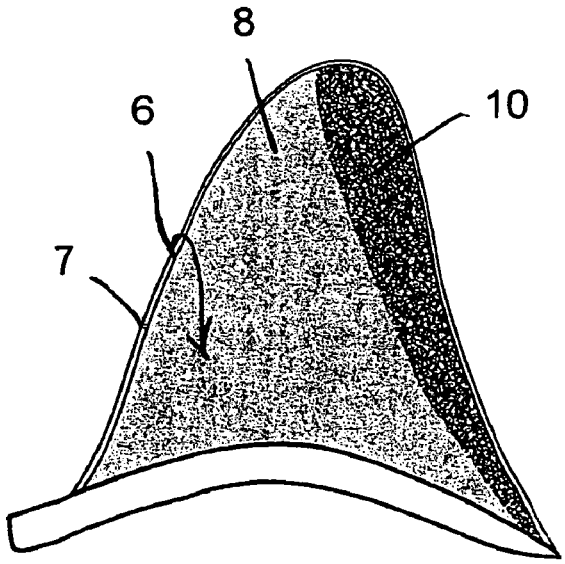
FIG. 7 is a cross-section through the knee roll on line L-L of FIG. 5.
Figure 8:
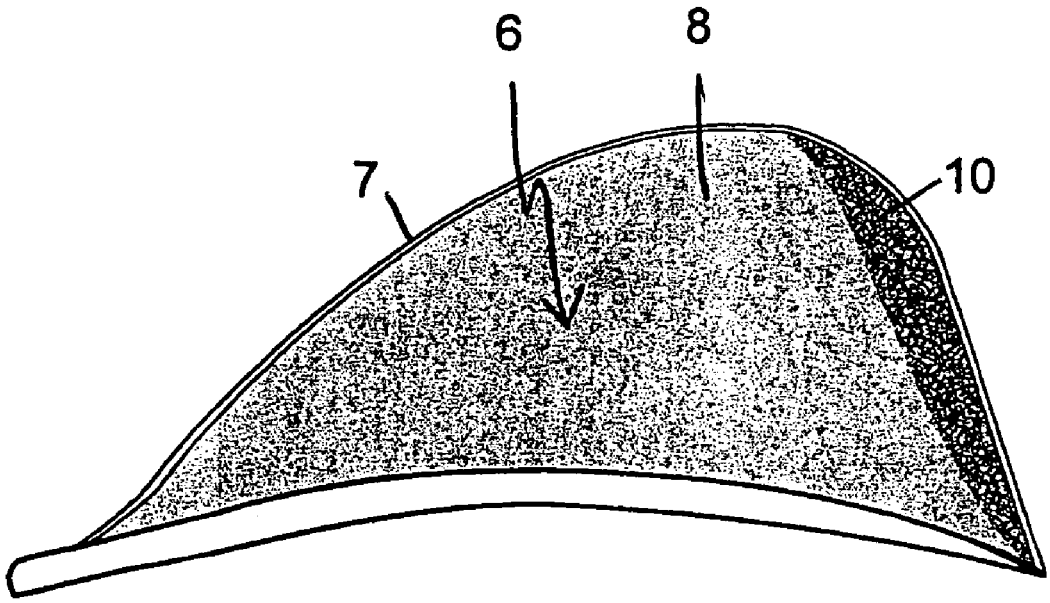
FIG. 8 is a cross-section through the knee roll on line U-U of FIG. 5.

The shape of the knee roll can best be understood with reference to the cross-sectional views of FIGS. 6 to 8 from which it will be seen that the concave shape extends from the lower part of the pad into the middle part and then tends to flatten somewhat in the upper part at which the retention effect required on the adjacent upper part of the thigh is not so critical as the main retention effect is required for the lower and middle parts of the thigh. It will also be seen that the thickness of the soft foam lining layer 10 increases outwardly from the base of the insert adjacent the body of the flap so that the maximum "softness" in feel is at the outer part of the rear face of the knee roll for added comfort. It will also be understood that owing to the softness and hence compressibility of the lining layer 10, it is principally the rear surface of the relatively hard moulding 8 which defines the thigh-retentive shape of the knee roll when the thigh is applied thereto. While this is the preferred construction, in an alternative the lining layer 10 could be omitted whereby the external shape of the knee roll corresponds to that of the moulding 8.

It is envisaged that this development in saddle design will provide significant improvement in saddle comfort and performance.

The invention claimed is:

1. A saddle for equestrian use, the saddle comprising flaps wherein the forward part of each flap is padded to form a knee roll, wherein each knee roll extends from a lower portion of its respective flap to an upper portion of its respective flap, wherein in a cross-section perpendicular to the extent of the knee roll, the rear face of each knee roll has a concave shape in a direction going from a base of the knee roll up to a peak of the knee roll, wherein the concave shape of the rear face is configured to conform to a shape of a rider's leg such that a rider's leg will tend to fit into the rear face when a lied thereto, and wherein the concave shape of the knee roll holds the rider's leg down so as to be retained against the saddle flap during working movements of the horse.

2. A saddle according to claim 1, wherein the knee roll is padded by an insert consisting of a relatively firm body having on a rear face thereof a relatively compressible layer and which is deformed against the body by pressure applied by the rider's thigh, the rear face of the body being concave in transverse section over at least part of its length to provide the concave shape of the rear face of the knee roll.

3. A saddle according to claim 2, wherein the rear face of the relatively firm body is concave in transverse section its lower and middle parts in its length direction.

4. A saddle for equestrian use, the saddle comprising flaps wherein the forward part of each flap includes a knee roll, wherein each knee roll extends from a lower portion of its respective flap to an upper portion of its respective flap, wherein in a cross-section perpendicular to the extent of the knee roll, the rear face of each knee roll has a concave shape in a direction going from a base of the knee roll up to a peak of the knee roll, wherein the concave shape of the rear face is configured to conform to a shape of a rider's lea such that a rider's leg will tend to fit into the rear face when applied thereto, and wherein the concave shape of the knee roll holds the rider's leg down so as to be retained against the saddle flap during working movements of the horse.

5. A saddle according to claim 4, wherein the rear face of the knee roll is of generally concave shape at least in its lower and middle parts.

* * * * *

UNITED STATES PATENT AND TRADEMARK OFFICE

CERTIFICATE OF CORRECTION

PATENT NO. : 7,562,514 B2
APPLICATION NO. : 11/588874
DATED : July 21, 2009
INVENTOR(S) : Kenneth John Bates It is certified that error appears in the above-identified patent and that said Letters Patent is hereby corrected as shown below:

In Column 2, line 66 - In Claim 1, change "a lied" to --applied--.

In Column 4, line 6 - In Claim 4, change "lea" to --leg--.

Signed and Sealed this

Thirteenth Day of April, 2010

David J. Kappos

David J. Kappos
*Director of the United States Patent and Trademark Office*